United States Patent [19]

Goldthorpe

[11] Patent Number: 4,995,611

[45] Date of Patent: Feb. 26, 1991

[54] MULTIMODE GAME BOARD

[76] Inventor: James F. Goldthorpe, Rte. 3, Box 2559, McMillan, Mich. 49853

[21] Appl. No.: 134,241

[22] Filed: Dec. 17, 1987

[51] Int. Cl.[5] ..... A63F 7/00; A63B 39/00; A47B 85/00; A47B 57/00

[52] U.S. Cl. ..... 273/123 R; 273/30; 273/285; 273/126 R; 108/19; 108/62

[58] Field of Search ..... 273/123 R, 4 C, 282, 273/126 R, 125 R, 30; 108/19, 62, 156, 13, 11, 115, 67, 118, 124, 123, 281

[56] References Cited

U.S. PATENT DOCUMENTS

| | | | |
|---|---|---|---|
| 305,913 | 9/1884 | Gately | 273/4 C |
| 1,259,888 | 3/1918 | McCormack | 273/123 R |
| 1,503,415 | 7/1924 | Fohmann | 273/123 R |
| 1,604,846 | 10/1926 | Nelson | 273/123 R |
| 1,819,932 | 8/1931 | Walden | 273/285 |
| 2,291,339 | 7/1942 | Lemoyne | 108/156 |
| 2,508,627 | 5/1950 | Spiegel et al. | 108/19 |
| 2,633,395 | 3/1953 | Zenner | 108/62 |
| 3,001,843 | 9/1961 | Davis | 108/62 |
| 3,425,696 | 2/1969 | Dockum | 273/285 |
| 4,019,739 | 4/1977 | Waite | 273/123 R |
| 4,474,374 | 10/1984 | Lewis et al. | 273/123 R |
| 4,609,192 | 9/1986 | Bratcher | 108/19 |

*Primary Examiner*—Edward M. Coven
*Assistant Examiner*—Gary Jackson
*Attorney, Agent, or Firm*—Julian C. Renfro

[57] ABSTRACT

A rectangularly shaped, multimode game board in accordance with this invention comprises at least one generally flat playing surface upon which game pieces can be rolled or slid by one player. My novel game board is supported by a plurality of legs, with the legs preferably being removable in pairs, such that the game board can be folded into a comparatively flat configuration for transit and/or storage. I may use a hinged joint at approximately at the midpoint of the game board, such that it can be folded into a comparatively small volume for storage transport. The multimode game board preferably has a generally flat playing surface on both of its major sides, with the pairs of removable legs being able to be installed in either of two orientations 180° apart, whereby the player or players can utilize the game board for at least two different games involving the use of game pieces that are caused to move along a generally flat playing surface. I also provide a device having an angled front surface, which device is able to be placed at the opposite end of the playing surface from a solitary player, for automatically returning a game piece rolled toward the device by the solitary player.

2 Claims, 6 Drawing Sheets

MULTIMODE GAME BOARD

BACKGROUND OF THE INVENTION

It is well known that a large number of game boards have been proposed, with many of such game boards having game pieces that are slid or rolled along the playing surface of the board. Some of such game boards are designed for the playing of a game in the nature of shuffle board, wherein each player strives to move his or her game piece along the playing surface into a scoring position located at the opposite end of the board.

Such a type of game is ideal for young people and seniors alike, who may not possess the skill or the vigor for undertaking shuffle board or other such games.

Unfortunately, some of the game boards of the prior art have been characterized by their size and weight, in that ordinarily quite a bit of set up time is required, and frequently such previous game boards have been so heavy as to involve the services of two or more people in order that they may be moved to another location, or placed in storage.

Additionally, prior art game boards have usually been designed only for the playing of one certain type of game, so that when the players tire of that game, there is no alternative game to which they can resort.

It was to overcome the disadvantages of the playing boards of the prior art that the present invention was designed.

SUMMARY OF THIS INVENTION

In accordance with this invention I have designed a generally rectangular multimode game board having at least one smooth, generally rectangularly shaped playing surface upon which one or more different types of game pieces can be slid or rolled. Around the playing surface I ordinarily provide a boundary in the nature of containment means, such that the game pieces will not roll off the edge of the playing surface and onto the floor.

Although my novel multimode game board can be utilized upon a table or other suitable support surface, in order that it may be utilized in a self-supporting manner, I prefer to utilize four legs, with one leg being mounted adjacent each corner of the device. In accordance with the primary embodiment of my game board, the legs are readily removable for either of two purposes, with one of these being at the time the board is to be taken down for placement in a closet, garage or the like, or else for transport to another location. The other purpose for removing the legs is when the game board is to be turned completely over, so that the second side of the board can be employed for the playing of another game, or for the utilization of the second side of the board for use for a comparatively unrelated purpose, such as a race track for toy racers, trucks or the like.

Another important aspect of the game board configurations I use involves the fact that my game board can have two different playing surfaces, one on each major side of the board. One of such playing surfaces may for example be in the general nature of shuffle board, but of course to a much smaller scale, whereas the playing surface on the opposite side of the board may be of an entirely different configuration, and for example permit wheeled toys to be utilized thereon.

In accordance with other embodiments of my game board, various types of folding legs are used in the support of the game board, with it being relatively easy to fold up the legs at the time the players are through using the board, so that the board can be stored in an out of the way position, or transported to another location. Instead of the legs being foldable only 90°, I have made certain folding leg embodiments of such configuration that the legs can be turned 180°. Thus it becomes quite convenient for the player or players to turn the board completely over, in the instance that another game, or a race track for toys, is utilized on the second major side of the game board.

A considerable amount of enjoyment of my invention has been derived from the fact that a primary purpose of my game board is to make possible a game much in the nature of shuffleboard, but played in a manner not requiring the players to change ends. This feature is particularly appreciated by players who may be confined to wheelchairs, or that have some other type of physical impairment.

Because youthful players as well as players in their golden years may not readily have the strength for moving my game board from one location to another, I provide one embodiment of my invention having a hinged joint utilized at approximately the midpoint of the playing surface, extending across the entire width of the game board. As a result of this construction, the game board can be folded at the midline joint, thus to facilitate transport as well as storage.

So as to make it possible for a solitary player to enjoy the use of my game board, I have provided a novel, generally triangularly shaped device that can be placed at a selected location on the playing surface, although this device is usually utilized adjacent one end of the game board. The triangularly shaped device has an inclined front surface such that a game piece can be slid or rolled by the solitary player along the playing surface of the game board, and thence up the inclined front surface of the device. The inclined front surface has a plurality of holes therein, into any one of which the game piece can enter, thus to enable the player to build up a score. The interior of the triangularly shaped device is configured such that a game piece entering one of the holes on the front surface can then be returned under the influence of gravity back to the player.

As a result of this advantageous leg arrangements I use, the player or players can erect or establish the legs so that the selected side of the game board can be upright, in the playing position, at a given time.

It is thus to be seen that a principal object of my invention is to provide a highly versatile game board, utilizable by one or a plurality of players, that can be employed in connection with different types of games.

It is another object of my invention to provide a multimode game board usable by players of all ages, but especially convenient for use by youthful players as well as senior citizens.

It is yet another object of my invention to provide a foldable game board of minimal weight and minimal cost, that can be readily deployed for a first game, and thereafter utilized, if desired, in an entirely different mode, after which the game board can be stored or readily transported to a new location.

It is still another object of my invention to provide a game board capable of a wide range of usages, but yet sized and configured as to be transportable, even by a person of senior citizen age.

It is still another object of my invention to provide a game board usable with any of a plurality of playing surfaces, wherein the use of several different types of folding leg arrangements enables a producer to select the most advantageous folding leg to manufacture in order to meet the particular needs of the game board.

These and other objects, features and advantages of my invention will be more apparent as the description proceeds.

DETAILED DESCRIPTION

Figure 1:
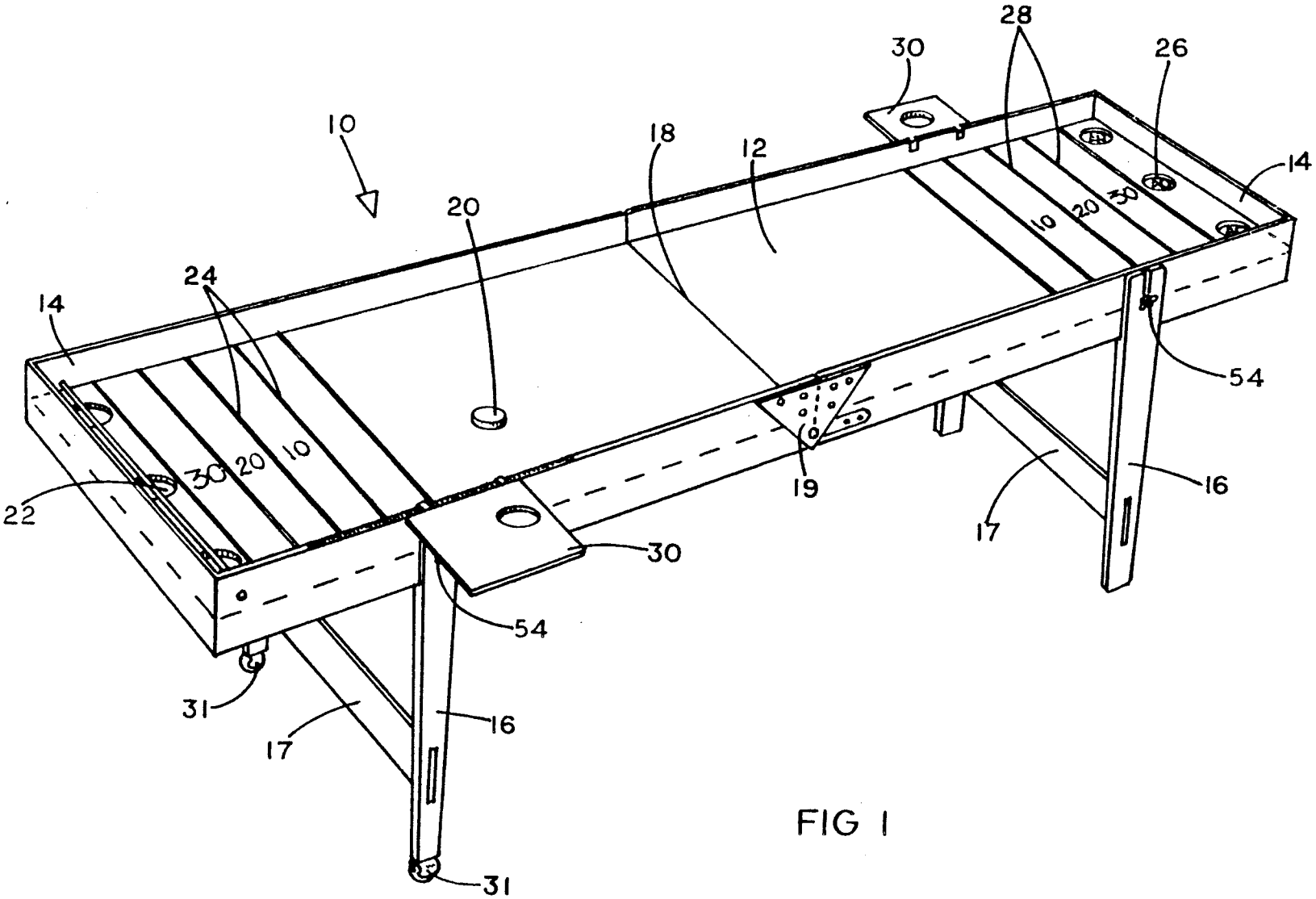
FIG. 1 is a perspective view of a preferred embodiment of my multimode game board, in this instance illustrating a game board foldable about a midpoint, and having readily removable legs.

With initial reference to FIG. 1, I have there shown a primary embodiment of my generally rectangularly configured, MultiMode Game Board 10, having at least one smooth, generally rectangularly shaped playing surface 12. Because at least two different types of game pieces are from time to time to be utilized on the playing surface 12, and it is not desired for such game pieces to fall onto the floor, I prefer to provide a boundary around the playing surface, hereinafter referred to as the containment means 14. The containment means may for example be made up of 1 inch by 4 inch lumber, although members of plastic or lightweight metal may be substituted for wood if desired. Furthermore, if desired, soft, resilient members may be used to form the containment means, so that a game piece can be expected to have a substantial amount of rebound.

My MultiMode Game Board may be utilized upon a table or other suitable support surface, but in order that it may be utilized in a self-supporting manner, I prefer to utilize four legs 16, one adjacent each corner of the device, which legs may be spaced say 12 inches from the near end of the game board.

Figure 9:
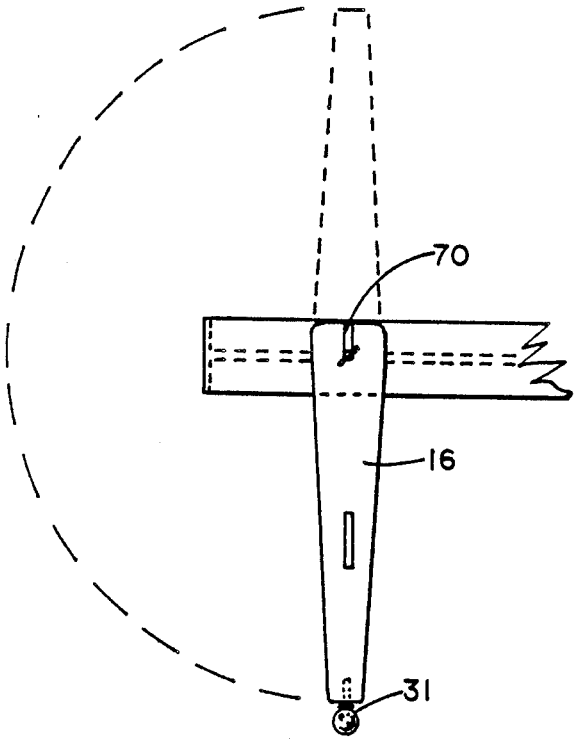
FIG. 9 is a view of the preferred type of leg arrangement, wherein the pair of legs at each end of a game board are removable together, either for storage, or so that the legs may be reinserted 180° away from the first position.
Figure 9A:
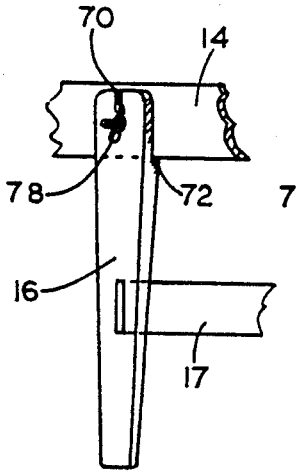
FIGS. 9A and 9B are fragmentary views revealing the shoulder utilized in the embodiment of FIG. 9, in order to provide great stability while the game board is in use.

In the embodiment of FIG. 1, the legs 16 have a slotted upper portion 70, best seen in FIGS. 9 and 9A. Legs configured in this manner are readily removable not only for ease of transport, but also to permit the game board to be turned completely over, so that the other major side of the board can be used in a completely different manner by the players. I have found it convenient to use casters 31 under one set of the legs 16, so that irrespective of which major side of the game board is up in a given instance, one player, by lifting the end of the game board opposite the castered legs, can move the game board around the room, much like a wheelbarrow.

The completely removable legs 16 in most instances have a brace member 17 at each end of the table, as shown in FIG. 1, so that these legs are removed in pairs. The removable legs are preferable to folding legs in many instances, and the details of legs 16 will be discussed at greater length in connection with FIGS. 9 and 9A.

Figure 2:
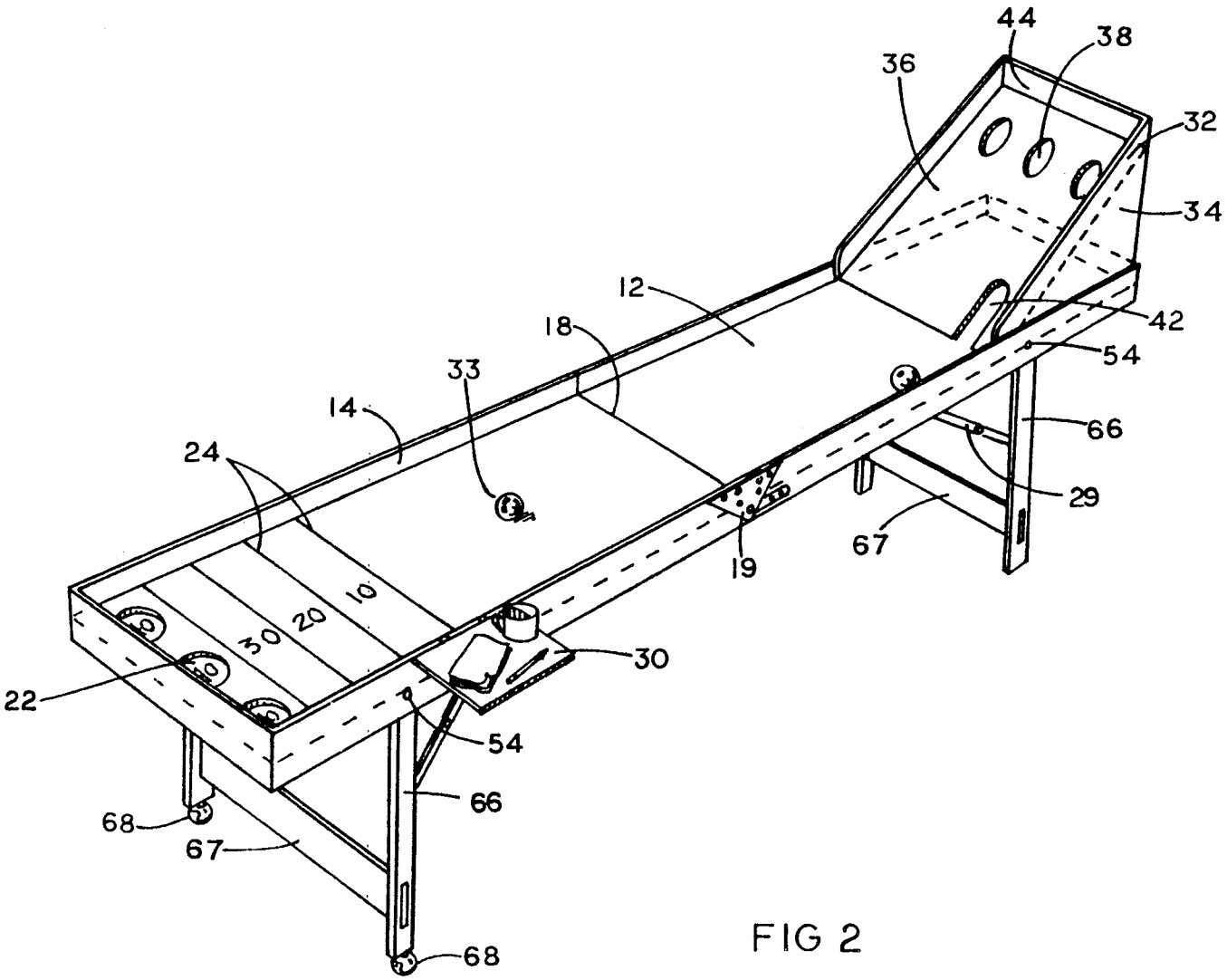
FIG. 2 is a perspective view much like FIG. 1, but having folding type legs, with this figure also illustrating a lightweight device having an angled front surface, such that by placing this device on the game board, a single player can test his or her skills in rolling a ball so as to cause it to enter selected holes in the device.

With reference to FIG. 2, it will be seen that the legs 66 in this embodiment are of the folding type. A brace 67 may be used between each pair of legs for reasons of strength and stability, and each brace 67 is positioned so as not to interfere with the folding of each pair of legs to a position in which the legs are essentially parallel with the playing surface 12. A bolt or other suitable pivot point 54 is utilized at the upper end of each leg 66, about which pivot points the legs move or pivot at the time the legs are folded. A pair of foldable locking braces 29 are utilized in connection with each leg, to assure that the legs 66 do not unexpectedly fold up during use of the game board.

As in the embodiment of FIG. 1, casters 68 are used on the legs at one end of the table, so that one player can readily move the game board about the room much like a wheelbarrow merely by lifting the opposite end of the game board.

Figure 10:
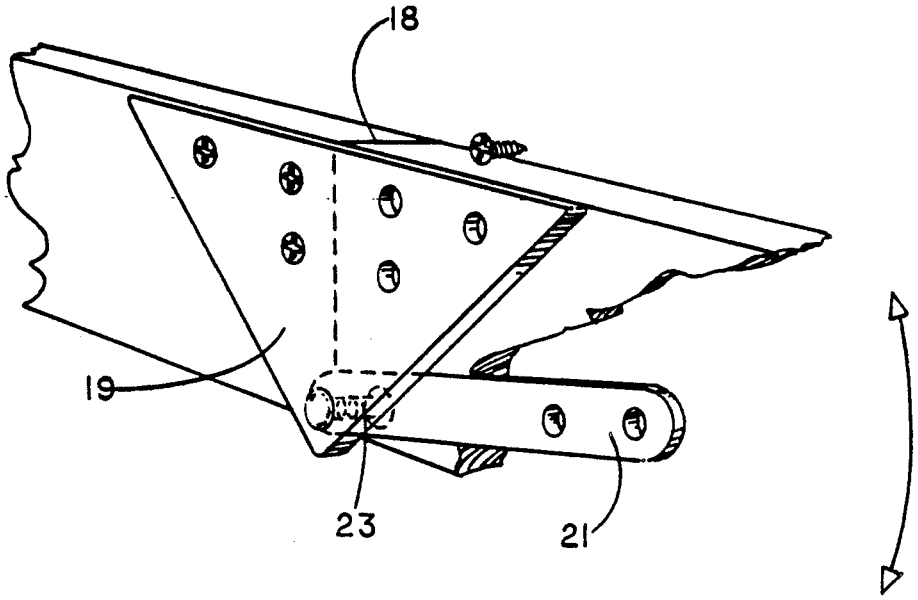
FIG. 10 is an enlarged view of the hinge details associated with the folding game board embodiments.

Although not required, I prefer for a hinged joint 19 to be utilized at approximately the midpoint of the playing surface of the embodiments of both FIG. 1 and FIG. 2, with such midline joint extending across the entire width of the game board. As a result of such arrangement, both of these game board embodiments can be folded at the midline joint 18 for ease of transport and for storage. If a folding game board is utilized, I prefer to use strengthening members on the underside so that the hinges 19 I use can attach to sturdy mounting means. A typical hinge is to be seen in FIG. 10, wherein hinge member 21 is used to provide a stable pivot point 23 about which the folding takes place.

Figure 6:
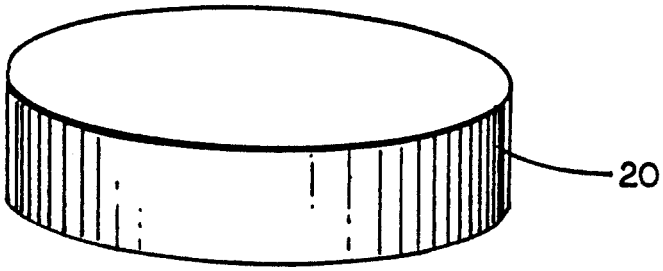
FIG. 6 is a view to a large scale of a typical disk shaped game piece, of the type utilized in FIG. 1, for example.

I prefer for one of the game piece utilized on the playing surface 12 of FIG. 1 to be a disk shaped device 20, which for example may be 2½ inches in diameter, and ¾ inch thick, with the flat surfaces on each side of the disk being treated to glide satisfactorily on the playing surface 12. A typical disk is illustrated in FIG. 6, and as will be described hereinafter, game pieces of other configurations may also be used on the playing surfaces of my game board. As one example, the disk can have only one flat side, and as another example, the game piece can be spherically shaped.

In order that my game board may lend itself for use in games involving skill and dexterity, I provide a plurality of holes of limited depth at each end of the game board, and in the event the game pieces are disks $2\frac{1}{2}$ inches in diameter, the series of holes 22 provided at the left side of the board shown in FIG. 1 are each, for example, $2\frac{3}{4}$ inches in diameter. Furthermore, I prefer to utilize a series 24 of scoring lines at the left side of the game board playing surface, as is readily visible in FIG. 1.

Because in a primary embodiment of my invention, this game is played with two players, I therefore provide a series of holes and a series of scoring lines on both ends of the game board playing surface, and in FIG. 1 I reveal a plurality of holes 26 at the right hand end of the game board, and adjacent thereto, a series of scoring lines 28.

Figure 7:
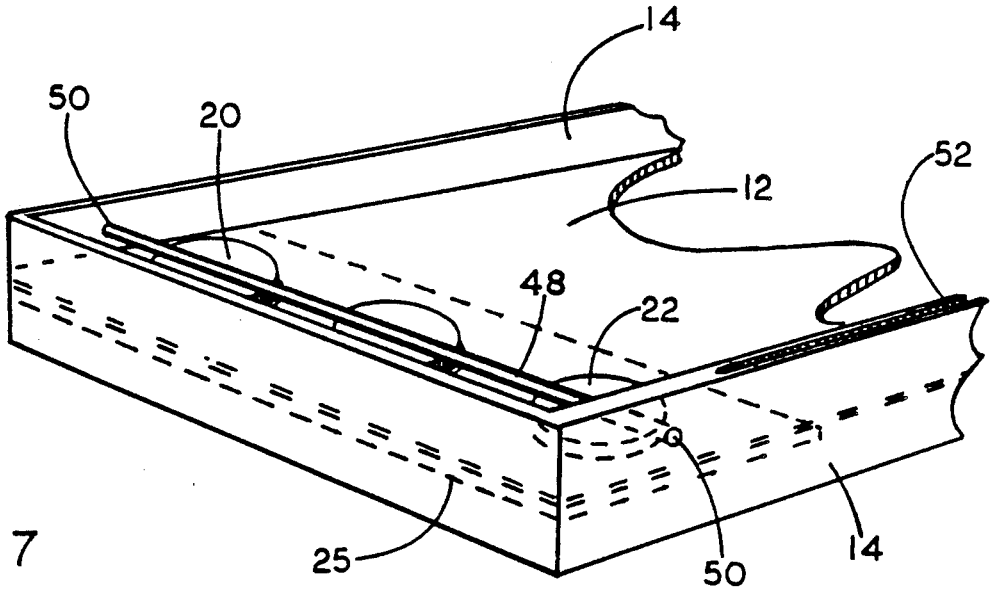
FIG. 7 is a fragmentary view representing an enlargement of the left end of FIG. 1, and revealing the disk retention means I may utilize.

As best seen in FIG. 7, beneath the surface 12, such as of marlite, a strip 25 of marlite some 4" wide is used, which properly retains the game pieces entering the holes, thus preventing the game pieces from falling through the holes onto the floor.

Inasmuch as some embodiments of my device are designed to fold along the midline joint 18, in the interests of portability, I prefer to have a means for retaining the three disk shaped game pieces 20 in respective holes 22 or 26 at the time of transport. As shown in FIG. 1, but in greater detail in FIG. 7, I may utilize a stick, rod or dowel 48 to hold the disks 20 in their holes, with the member 48 being received in aligned holes 50 located in opposite sidewalls 14 of my game board. To resume play, the user slides the dowel 48 out of the position shown in FIG. 7, and places it in a tight-fitting groove 52 provided in the side rail for such purpose until he or she decides to fold up the board for storage or transport.

Although I am not to be limited to any particular dimensions, the playing surface 12 on each side of the midline joint 18 may be a sheet of white marlite some 15 inches wide and some 41 inches long, with the containment means 14 being of such dimension that the overall size of my game board is approximately 16 inches wide and 84 inches long. Obviously a game board in accordance with this invention could be made in a somewhat different size, but the above-mentioned size has been found to be particularly convenient when the users are senior citizens or young people, for the ability of some players to lift a heavy game board may be somewhat limited. A game board of the aforementioned size may weigh approximately 25 pounds. If hinged at the midline joint 18, the game board may be folded into a compact package approximately 43 inches by 16 inches by 8 inches thick.

To add to the players' enjoyment, I may provide a combined score table and coffee cup holder 30 near each end of the game board, as depicted in FIGS. 1 and 2. On both of these devices 30 is a flat surface suitable for writing upon, and also a hole of a sufficiently small size that a cup can be placed therein, and not fall through onto the floor. The two score tables 30 are preferably secured to the upper edge of the boundary or containment means 14 near the respective ends of the game board 10, and may be designed to be readily removable at the time the game board is to be stored or transported.

When my game is to be utilized in its primary mode, one player is at each end of the game board, and each takes his or her turn in causing each game piece 20 to slide substantially the entire length of the playing surface of the game board, and to land within one of the three holes located at the opposite end of the board.

Advantageously, it is not necessary in the use of my game for the players to move away from their respective ends of the game board. This is because the players take turns sliding the game pieces from the end at which they reside, to the opposite end of the board, with the score counted and recorded after each turn has been taken.

It is recognized that it is not always possible for a given player to cause all three of the game pieces he or she is using, to slide into the three holes located at the opposite end of the board's playing surface. Accordingly, I prefer to utilize the aforementioned plurality of scoring lines 24 and 28 such that the player failing to cause all three disks to land in a respective hole will nevertheless accumulate some score. For example a player can add 10 points to his score by causing his disk to land between one pair of scoring lines; to add 20 points to his score by his disk landing between a second pair of scoring lines; and to add 30 points to his score by causing the disk to land between a third pair of scoring lines. Usually the higher scores are associated with closeness to the hole locations.

So that the game will not be too easy, I prefer to accord a negative score to a player causing his disk to land in the vicinity of the holes, but not in a hole, or in other words, 10 points may for example be deducted from his score for each disk ending up in the end zone, but not entering a hole.

It is to be noted that although my game is somewhat like shuffleboard, it is played on a much smaller playing surface, and in addition, it differs by not in every instance giving the one player the opportunity to knock the other player's disks away from a score-accumulating position. In contrast, in shuffleboard, the player last to play has the opportunity to knock the other player's disks out of a scoring position.

As should now be clear, in a typical instance, two players are playing the game, with each player being permitted to remain at a certain end of the game board throughout the game. A total of three disks may be utilized, with the first player sliding the three disks toward the other end of the playing surface in an effort to cause the disks to land in the holes at the other end of the board, or at a minimum, to cause his or her disks to come to rest in a favorable relationship to the respective scoring lines on the playing surface.

After the first player's turn, the second player proceeds to slide the three disks in the opposite direction along the playing surface 12 of the game board, that is, back toward the holes and the scoring lines adjacent the first player. After a given number of turns have been taken, the scores are added and the winner decided.

As will be discussed hereinafter, I am not limited to two players, for quite obviously, a larger number of players may be utilized, particularly with regard to a game board configuration to be described hereinafter in connection with FIG. 8.

Figure 4:
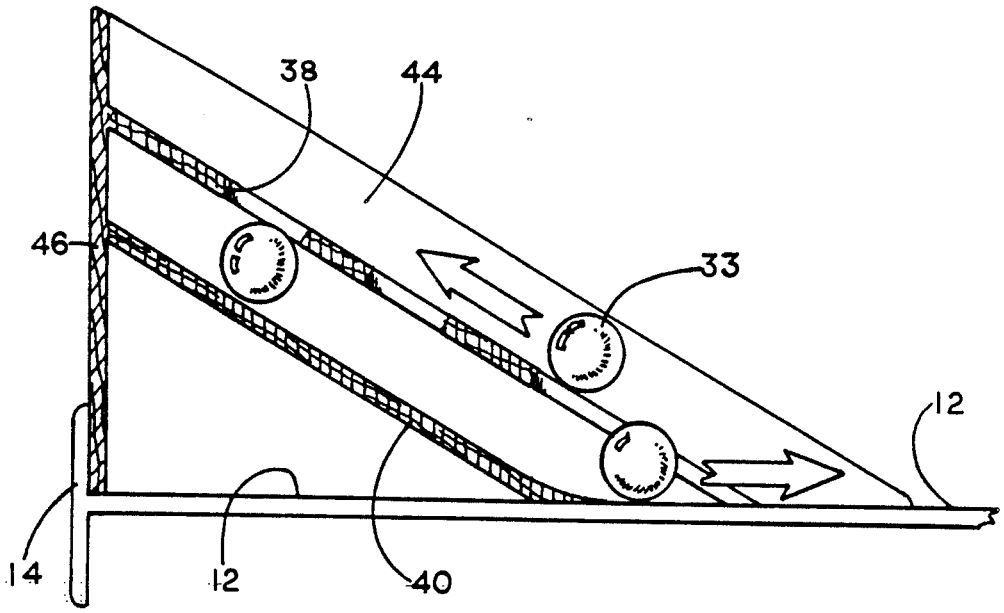
FIG. 4 is a cross sectional view, to a comparatively large scale, of the portable device of FIG. 2 having an angled front surface.

It is possible that a second player cannot be found, so to that end, I have provided a generally triangularly shaped device 32 of the type shown in FIGS. 2 and 4, that can be placed at a selected location on the playing surface 12. Typically the generally triangularly shaped device is placed adjacent an end of the game board remote from the one player, with such device being configured to cause the return of the game piece to the player.

With particular reference to FIG. 2, it will be seen that I have there revealed that the generally triangularly shaped device 32 may be placed adjacent one end of the game board 10. The generally triangularly shaped device 32 has a member 34 that is generally in the configuration of a right triangle on each side, that is, on its left and its right sides. Thus, the members 34 serve to support the angled front surface 36 at approximately a 30° angle to the playing surface 12. In one preferred embodiment, the angled front surface 36 reached a height of 10 inches at the location where it contacted the vertical rear member 46, or in other words, not considering the boundary 44, and the length of the device 32 was approximately 17 inches from front to back. Obviously, I am not to be limited to these dimensions. Additional details of the generally triangular device 32 may be readily seen in FIG. 4.

A plurality of holes 38, preferably three in number, are provided on an upper portion of the inclined front surface 36, with the object of this part of the game being for the solitary player to cause the game piece, which may be a spherical member 33, to enter a selected hole 38 in the angled device 30. As is obvious, different point values can be ascribed to the several holes in the inclined device, thus making it possible for the solitary player to improve upon his or her score by a bit of practice. A boundary 44 is utilized around three sides of the angled front surface 36, to keep the game piece from rolling off an edge of the device 32, onto the floor.

By virtue of the advantageous construction of the generally triangularly shaped device 32 shown in FIG. 4, the playing piece or game piece can be caused to return to the solitary player. Although different types of game pieces can be used in playing this aspect of the game, I have found it generally more satisfactory for the game piece to be a ball in the nature of a golf ball 33 when the solitary player is using the angled device 32.

As revealed in FIG. 4, upon the golf ball entering any of the holes 38 in the inclined front surface 36, the ball then falls upon an angled interior floor member 40 located in the interior of the generally triangularly shaped device. As viewed in this particular instance, the right hand portion of the floor member 40 is the lowest point. As viewed in FIG. 2, the right hand end of the floor member 40 is the lowest point. As a consequence, each ball falling through a hole 38 rolls to the front right hand edge of the angled device 32, from which location the ball returns under the influence of gravity to the solitary player.

As will be noted from FIG. 2, I provide an appropriately placed return chute 42, such that the ball rolls toward the chute 42, and thereafter rolls through the chute and back to the player. Although I could have placed the return chute in the lower central portion of the device 32, I prefer it to be located on one side of the angled front surface 36, such as on the right hand side of the device, as shown in FIG. 2. Thus, it is to be seen that a golf ball entering one of the several holes 38 in the inclined front surface 36 will be caused to travel across the interior floor member 40, down the return chute 42, and then roll back along the playing surface 12 toward the solitary player standing at or near the opposite end of the table.

As is obvious, this player can see how many times he or she can cause the ball to enter one of the holes 38 in the inclined surface 36, and thereafter emerge through the return chute 42.

Figure 3:
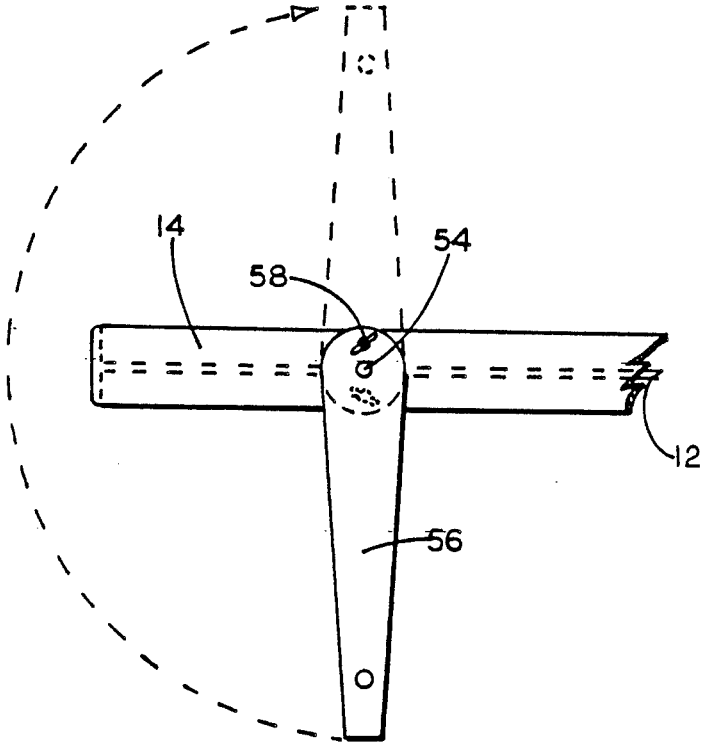
FIG. 3 is a fragmentary view illustrating one type of rotatable leg I may utilize on my game board.

With reference now to other aspects of my novel game board, it will be recalled in connection with the embodiment of FIG. 2 that each pair of legs 16 I prefer to utilize in this embodiment may be mounted to move at least 90° about their respective pivot points, and in this regard, such legs may closely resemble the legs utilized on certain tables designed for home or light industrial use. As an alternative, I may mount the legs on the outer portions of the side rails or boundary members 14, such that the legs can be swung for a greater number of degrees than 90°. In FIG. 3 I show an example of a type of leg 56 that may be swung 180° about the pivot point 54. In order that leg 56 may be prevented from moving away from a selected position, I provide one hole slightly removed from the pivot 54, and then two holes in the member 14, with latter two holes being 180° apart, in a diametral relationship to the pivot 54. The two holes in the member 14 are so located that whether the leg 56 is in the position shown in full lines in FIG. 3, or in the 180° position shown in dashed lines in FIG. 3, a pin or threaded bolt may be inserted through the hole in the leg when it is aligned with the selected hole in the member 14, as will cause the leg 56 to be secured in the selected location. Head 58 of the threaded bolt or pin is visible in FIG. 3.

In an embodiment of the type shown in FIG. 3, the leg braces 17 must be sufficiently far away from the central pivot points 54 of the legs 56 as not to interfere with the legs being rotated 180° away from a first operative position to a second operative position.

In the embodiment of FIG. 3, it is preferable to utilize leg securing means of the aforementioned type, that do not necessitate a wrench, screwdriver or any other tool being utilized at the time the legs are to be rotated, and then folded, or else secured in a new position.

As should now be clear, by rotating the legs of both pairs 180°, the player or players can then cause the game board to be erected such that the playing surface previously on the underside of the game board will be caused to be upright.

Figure 5:
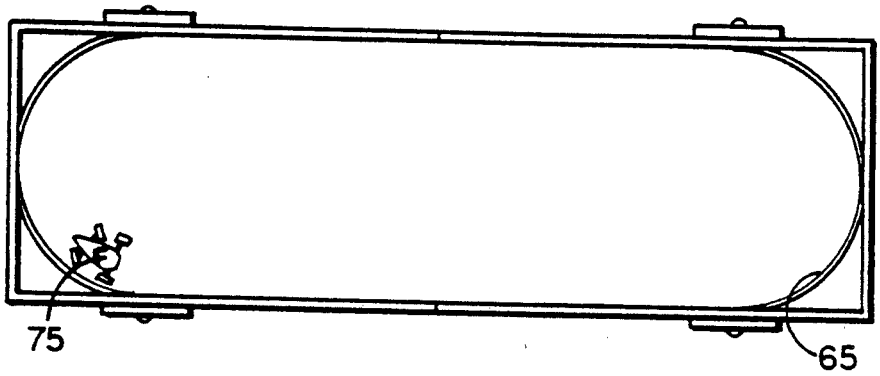
FIG. 5 is an embodiment of a game board in accordance with this invention, in which a toy racer or the like may be caused to run around a race track, with this embodiment being usable for a wide range of toys.

It is to be realized that in accordance with my invention, I may provide a game board having different types of game surfaces thereon, and particularly advantageous are arrangements in which one type of playing surface is located on one side of the game board, and a different playing surface located on the other side. FIGS. 5 and 8 are illustrative of the type of playing surfaces that may be utilized on opposite sides of the same game board.

As shown in FIG. 5, I may utilize a playing surface in the form of an oblong track 65 suitable for use in conjunction with a game piece in the nature of a model automobile 75 or a model train, which can either be hand powered or electrically powered, and as is obvious, such model vehicle can travel either on a track, or it can move to any of an infinite number of positions on the playing surface. If electrically powered, the game piece could be radio controlled.

Figure 8:
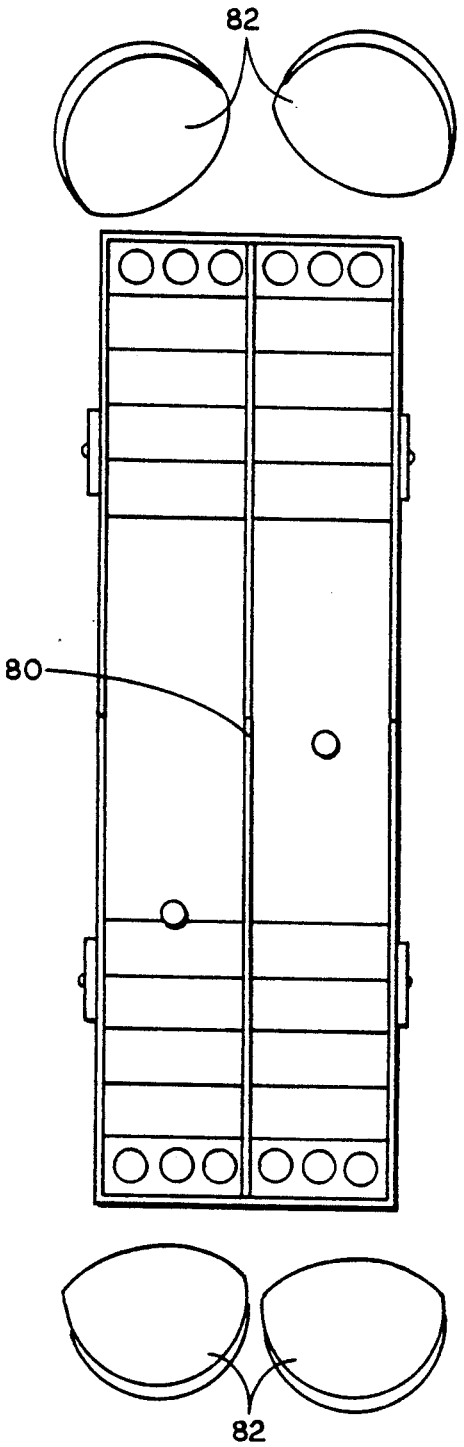
FIG. 8 is a game board of the type usable by more than two players at the same time, and it should be noted that this embodiment may be utilized on the side opposite the race track version of the game board shown in FIG. 5.

As shown in FIG. 8, the playing surface on the opposite side from the primary playing surface can involve a "double" arrangement in which there are a pair of parallel playing surfaces, along which a game piece may be caused to slide. Because of the utilization of a central dividing member 80, which the game pieces ordinarily cannot cross, it is possible for one pair of players to be utilizing the part of the game board shown on the left hand side in FIG. 8, and for a different pair of players to be utilizing the part of the game board shown on the right hand side in FIG. 8.

As before, a plurality of holes and a plurality of scoring lines are utilized at each end of each playing surface, but the arrangement is such that four persons rather than just two can be pursuing the game at any given moment. The players could be seated in chairs 82.

Figure 9B:
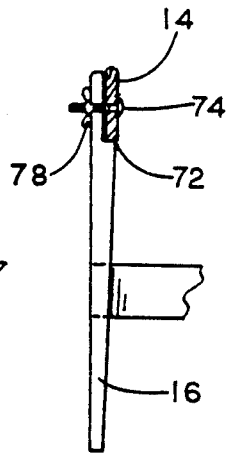

In FIGS. 9, 9A and 9B I have shown another variation in leg construction, in which a long vertical slot 70 is utilized at the top of the leg 16, so that upon loosening of the wing nut 78 of the mounting bolt 74, the leg may be readily removed, and reinstalled in a position 180° from the first position. Such a new leg position is of course depicted in dashed lines in FIG. 9. A caster 31 is shown on the leg 16 depicted in full lines in FIG. 9, for the previously mentioned purpose of enabling one player to readily reposition the game board from one part of a room to another.

It is important to note in this embodiment that a shoulder 72 is used on the inner surface of the upper part of the leg, as illustrated in FIG. 9A and 9B. The shoulder 72 is designed to be in firm contact with the bottom edge of the structural member 14, also known as the containment member, whether each leg is in the full line position, or in the dashed line position 180° away from the full line position. The use of this shoulder 72 in abutting relation with the member 14 causes the leg to be very secure at such time as the wing nut 78 used with the leg 76 has been tightened upon the bolt 74.

Figure 11:
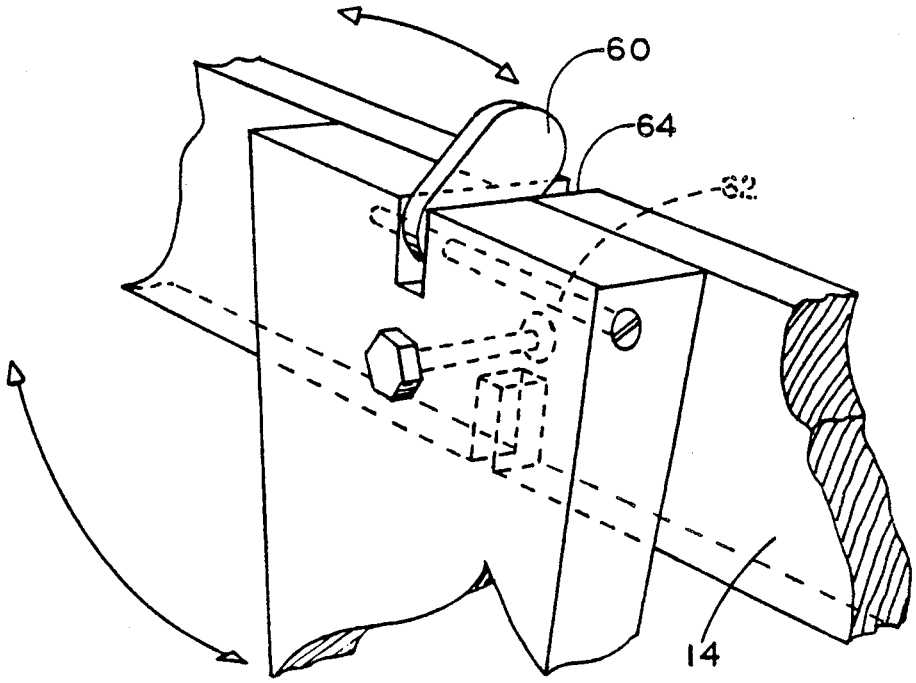
FIG. 11 is an enlarged fragmentary view of a still further type of rotatable leg.

In FIG. 11 I show still another leg embodiment, this one involving a flat member 60 pivotally mounted on a bolt 62 located in the upper end of a leg, which flat member 60 can enter an appropriately configured slot 64 in the structural member 14 (containment member) adjacent the leg. In this way, the leg can be held firmly in a first selected position, and then, if the players elect to turn the entire game board 180° to dispose the other playing surface in the playing position, the leg can also be firmly held in a second selected position. Another slot is on the opposite side of the member 14, in alignment with the slot 64. The flat member 60 can be easily moved toward and away from the position engaging the adjacent slot, irrespective of the playing surface that is upward in a given instance. As is obvious, when the member 60 is in engagement with the selected slot 64, the leg is positioned very stably.

I claim:

1. A rectangularly shaped, multimode game board comprising at least one generally flat playing surface upon which game pieces can be rolled or slid by one player, said game board being supported by a plurality of legs, and said legs being removable in pairs, whereby said game board can be folded into a comparatively flat configuration for transit and/or storage, a generally triangularly shaped device having an angled front surface usable at a selected location on at least one of said playing surfaces, said angled front surface having a plurality of holes therein, thus forming an opportunity for a player to test his or her skill by causing a game piece to move along at least part of the playing surface, up the angled front surface of said triangularly shaped device, and thence into one of said holes, and a return slot provided in a lower part of said angled front surface, such that the game piece can return under the influence of gravity back along the playing surface to the player.

2. A rectangularly shaped, multimode game board comprising at least one generally flat playing surface upon which game pieces can be rolled or slid by one player, said game board being supported by a plurality of legs, and said legs being foldable, whereby said game board can be folded into a comparatively flat configuration for transit and/or storage, a generally triangularly shaped device having an angled front surface usable at a selected location on at least one of said playing surfaces, said angled front surface having a plurality of holes therein, thus forming an opportunity for a player to test his skill by causing a game piece to move along at least part of the playing surface, up the angled front surface of said triangularly shaped device, and thence into one of said holes, and a return slot provided in a lower part of said angled front surface, such that the game piece can return under the influence of gravity back along the playing surface to the player.

* * * * *